United States Patent [19]

Grill

[11] Patent Number: 4,671,597

[45] Date of Patent: Jun. 9, 1987

[54] POWER INDICATOR LIGHT

[76] Inventor: Edward Grill, Box 526, Harlem, Mont. 59526

[21] Appl. No.: 860,312

[22] Filed: May 6, 1986

[51] Int. Cl.[4] ..... H01R 3/00

[52] U.S. Cl. ..... 362/253; 439/490; 439/620; 439/488

[58] Field of Search ..... 339/113 L, 113 R, 176 R, 339/192 R

[56] References Cited

U.S. PATENT DOCUMENTS

| | | | |
|---|---|---|---|
| 2,112,137 | 3/1938 | Brach | 339/113 L |
| 2,449,150 | 9/1948 | Schnoll | 339/113 L |
| 3,753,261 | 8/1973 | Thaxton | 339/113 L |
| 4,386,818 | 1/1983 | Millhimes et al. | 339/113 L |
| 4,520,239 | 5/1985 | Schwartz | 339/113 L |

*Primary Examiner*—Eugene F. Desmond
*Assistant Examiner*—Thomas M. Kline
*Attorney, Agent, or Firm*—Richard C. Litman

[57] ABSTRACT

An improved female electrical receptacle connected to an electrical power extension cord has a power indicator light to signal that the extension cord has power.

1 Claim, 5 Drawing Figures

POWER INDICATOR LIGHT

FIELD OF INVENTION

This invention relates to an improved receptacle for a two-wire or three-wire electric power extension cord. Specifically, it relates to a female receptacle having a power indicator light.

BACKGROUND OF INVENTION

Many improved electric plug adaptors and electric power extension cords of the prior art as directed to such purposes as suppressing transient current surges, indicating the polarity of receptacle terminals, and providing diagnostic indications as to the integrity of grounding connections by signal means on the plug adaptor or on male plug of the power extension cord, e.g. U.S. Pat. Nos. 2,474,407; 3,924,914; 4,089,032 and 4,118,690. However, none of these patents are believed to disclose the present invention.

SUMMARY OF INVENTION

It is the object of this invention to provide a female receptacle on an electric power extension cord comprising signal means for indicating whether or not there is power on the line, i.e. whether the male plug of the extension cord is plugged into an electric power outlet and whether that outlet has power. When a long power extension cord is used for remote appliances, an indication at the female receptacle whether the cord has power saves the user considerable time and effort.

The signal means is a small lamp in an enclosure having a transparent window, the enclosure being closed by a threaded cylindrical plug.

DETAILED DESCRIPTION OF THE PREFERRED EMBODIMENT OF THE INVENTION

Figure 1:
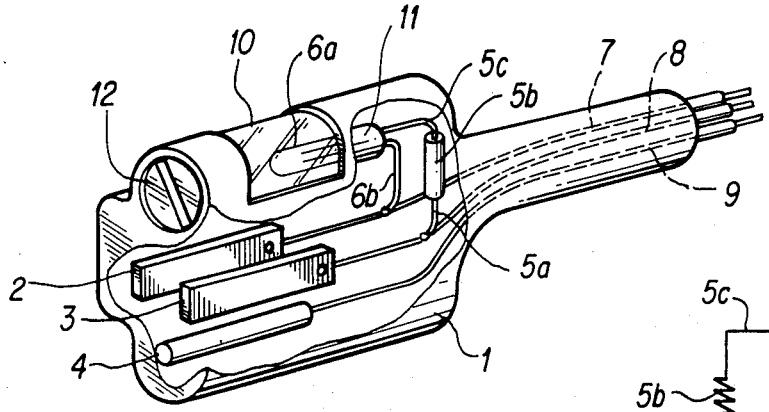
FIG. 1 is a perspective view of the female receptacle of a three-wire electric power extension cord in accordance with this invention.

Referring to FIG. 1, there is shown the female receptacle 1 of a three wire electric power extension cord having a recessed "hot" terminal 2, a recessed neutral terminal 3 and a recessed ground terminal 4. Connected to the neutral terminal 3 by a wire 5*a* is a resistor 5*b*, for example 30,000 ohms rated for 0.5 watt power dissipation, the resister 5*b* being further connected in series by a wire 5*c* to a lamp 6*a*, typically an A1A lamp, which is further connected via a wire 6*b* to the "hot" terminal 2.

The "hot" terminal 2 is further connected to the "hot" wire 7, the neutral terminal 3 is connected to the neutral wire 8, and the ground terminal 9 is connected to the ground wire 9, wires 7, 8 and 9 being insulated conductors constituting the power extension cord and leading to a male plug.

Lamp 6*a* is mounted in a socket 11 disposed inside an enclosure in the body of the plug 1, having a transparent plastic window 10 through which the lamp 6*a* may be seen from the outside. The lamp enclosure is closed by a cylindrical threaded plug 12 having a male thread and a slotted head, said male thread matching female thread on the inside periphery of the lamp enclosure opening.

The threaded plug 12 may be inserted and screwed into the lamp enclosure opening and turned with a screwdriver inserted in the slot in the head of the plug 12. FIG. 1 executes in perspective a hollow enclosure in the insulating body 1 for accommmodating and housing the lamp 6*a* and in which the hollow enclosure is accessible only through an opening in the generally planar surface of the body 1, the hollow enclosure having on one side the window 10 made of transparent material whereby the lamp 6*a* is visible from the outside, plug 12 for sealing said hollow enclosure and it having a defined planar surface, and the transparent plastic window 10 being provided on said hollow enclosure for the lamp 6*a* to be visible from the outside.

In operation, when the male plug of the extension is plugged into an electrical outlet which is under power, the "hot" wire 7 and the "hot" terminal 2 will indeed be "hot" and consequently a small current will flow through the wire 6*b*, lamp 6*a*, wire 5*c*, resistor 5*b* and wire 5*a* to neutral terminal 3 and neutral wire 9. Lamp 6*a* will light up, which may be observed through the transparent window 10.

Figure 2:
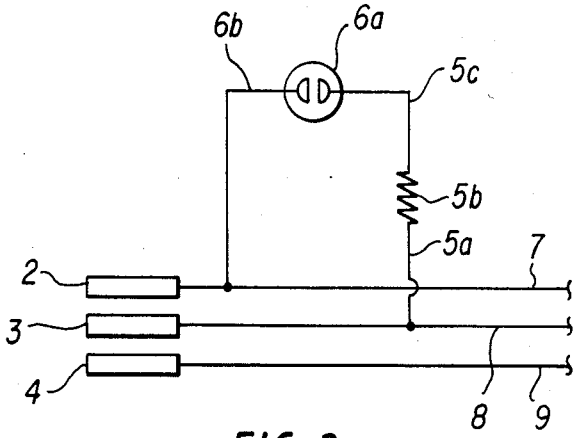
FIG. 2 is a schematic wiring diagram of the female receptacle of a three-wire electric power extension cord in accordance with this invention.

FIG. 2 illustrates the electric elements of this invention and their interconnection in the form of a schematic circuit diagram.

Figure 3:
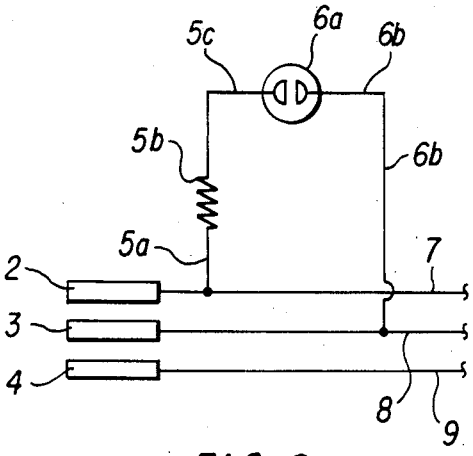
FIGS. 3 and 4 are schematic wiring diagrams illustrating alternative methods of electrically connecting elements of this invention.
Figure 4:
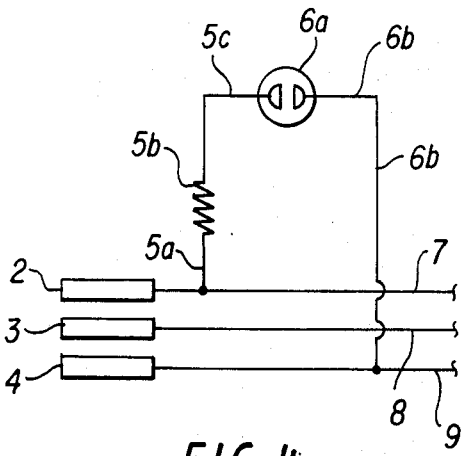

FIGS. 3 and 4 illustrated two additional alternative methods of electically interconnecting the elements of this invention for three-wire electric power chords.

Figure 5:
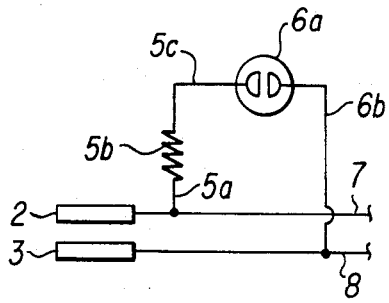
FIG. 5 schematically illustrates the invention as applied to a two-wire power extension chord.

FIG. 5 illustrates the invention as applied to a two-wire power extention cord While various changes may be made in the detailed construction of this invention, it is underestood that such changes will be within the spirit and scope of the invention as defined by the following claims.

I claim:

1. A female electrical receptacle connected to an electric power extension cord, comprising an electrically insulating body having a side defining a generally planar surface for interfacing with a male plug, a "hot" terminal and a neutral terminal, an electrical resistor and an electrical lamp each having two terminals, the first terminal of the resistor being connected to the "hot" terminal, the second terminal of the resistor being connected to the first terminal of the lamp, the second terminal of the lamp being connected to the neutral terminal, a hollow cylindrical enclosure within said insulating body for accommodating said lamp and in which the hollow cylindrical enclosure is accessible only through an opening in the generally planar surface of the body, said opening being provided for access to said lamp for its removal and replacement thereof, the hollow cylindrical enclosure having on one side a window made of a transparent material whereby the lamp is visible from the outside, means for sealing said hollow enclosure including a cylindrical plug having a defined planar surface, said opening having female threads which engage male threads provided on said cylindrical plug whereby said hollow cylindrical enclosure is sealed by said cylindrical plug, the planar surface of said cylindrical plug being disposed in the same plane as that of said planar surface of said body, and said planar surface of said cylindrical plug further comprising slot means.

* * * * *